US010654098B2

(12) United States Patent
Grange et al.

(10) Patent No.: US 10,654,098 B2
(45) Date of Patent: May 19, 2020

(54) REFRACTORY CORE COMPRISING A MAIN BODY AND A SHELL

(71) Applicant: SAFRAN, Paris (FR)

(72) Inventors: David Grange, Moissy-Cramayel (FR); Ngadia Taha Niane, Moissy-Cramayel (FR)

(73) Assignee: SAFRAN, Paris (FR)

( * ) Notice: Subject to any disclaimer, the term of this patent is extended or adjusted under 35 U.S.C. 154(b) by 127 days.

(21) Appl. No.: 16/069,593

(22) PCT Filed: Jan. 13, 2017

(86) PCT No.: PCT/FR2017/050082

§ 371 (c)(1),
(2) Date: Jul. 12, 2018

(87) PCT Pub. No.: WO2017/121972

PCT Pub. Date: Jul. 20, 2017

(65) Prior Publication Data

US 2019/0111470 A1 Apr. 18, 2019

(30) Foreign Application Priority Data

Jan. 15, 2016 (FR) ..... 16 50332

(51) Int. Cl.

| | |
|---|---|
| ***B22C 9/10*** | (2006.01) |
| ***B22C 9/24*** | (2006.01) |
| *F01D 5/18* | (2006.01) |

(52) U.S. Cl.

CPC ..... *B22C 9/10* (2013.01); *B22C 9/24* (2013.01); *F01D 5/186* (2013.01); *F05D 2230/21* (2013.01); *F05D 2260/202* (2013.01)

(58) Field of Classification Search

CPC ..... B22C 9/10; B22C 9/24

See application file for complete search history.

(56) References Cited

U.S. PATENT DOCUMENTS 5,295,530 A * 3/1994 O'Connor ..... B22C 9/04 164/133
2016/0121389 A1* 5/2016 Slavens ..... B22F 5/009 164/9

FOREIGN PATENT DOCUMENTS

| | | | |
|---|---|---|---|
| CN | 1628922 | A | 6/2005 |
| CN | 1644271 | A | 7/2005 |
| CN | 1683098 | A | 10/2005 |
| CN | 1745938 | A | 3/2006 |
| CN | 1923407 | A | 3/2007 |
| DE | 19821770 | C1 | 4/1999 |

(Continued)

OTHER PUBLICATIONS

Search Report dated Sep. 8, 2016, in priority application FR 1650332 (6 pages).

(Continued)

*Primary Examiner* — Kevin E Yoon

(74) *Attorney, Agent, or Firm* — Bookoff McAndrews, PLLC

(57) ABSTRACT

A refractory core (12) for fabricating a hollow turbine engine airfoil (10) using the lost-wax casting technique, the core comprising a main body (14) and at least one shell (16) connected to the main body (14) and defining a cavity (18) between the main body and the shell, the shell (16) being configured to come into contact with the airfoil (10) during fabrication.

11 Claims, 1 Drawing Sheet

(56) References Cited

FOREIGN PATENT DOCUMENTS

| | | | |
|---|---|---|---|
| EP | 1266706 | A1 | 12/2002 |
| EP | 1543896 | A2 | 6/2005 |
| FR | 2961552 | | 12/2011 |
| RU | 2337786 | C1 | 11/2008 |
| RU | 2374031 | C2 | 11/2009 |
| RU | 2432224 | C2 | 10/2011 |
| WO | 2009/127721 | A1 | 10/2009 |

OTHER PUBLICATIONS

Official Communication dated Oct. 21, 2019, in corresponding CN Application No. 201780006887.7 (6 pages).
International Search Report and Written Opinion with English translation dated Jun. 21, 2017, in corresponding International Application No. PCT/FR2017/050082 (10 pages).
Official Communication issued in corresponding Russian Application No. 2018129571 dated Mar. 12, 2020 (5 pages).

* cited by examiner

REFRACTORY CORE COMPRISING A MAIN BODY AND A SHELL

CROSS-REFERENCE TO RELATED APPLICATIONS

This application is the U.S. national phase entry under 35 U.S.C. § 371 of International Application No. PCT/FR2017/050082, filed on Jan. 13, 2017, which claims priority to French Patent Application No. 1650332, filed on Jan. 15, 2016, the entireties of each of which are herein incorporated by reference.

FIELD OF THE INVENTION

The present disclosure relates to lost-wax type casting, and more particularly to a refractory core for fabricating a hollow turbine engine airfoil by lost-wax casting.

TECHNOLOGICAL BACKGROUND

In known manner, a turbine engine has a combustion chamber in which air and fuel are mixed prior to being burnt therein. The gas resulting from that combustion flows downstream from the combustion chamber, subsequently feeding a high pressure turbine and a low pressure turbine. Each turbine has one or more rows of stationary airfoils constituting guide vanes alternating with one or more rows of moving airfoils constituting blades (bladed disks or "blisks"), in which the airfoils are spaced apart circumferentially all around the rotor of the turbine. Those turbine airfoils are subjected to the very high temperatures of the combustion gas, which temperatures can reach values that are well above the temperatures that the airfoils in contact with the gas can withstand without damage, which implies that it is necessary to cool them continuously by means of respective integrated cooling circuits, where such a circuit includes multiple cavities when it is desired to provide cooling that is effective and accurate without significantly increasing the flow rate of air and without penalizing the performance of the engine. Hollow airfoils formed in this way are fabricated by the so-called "lost-wax" casting method, which requires the use of a core or model part having an outside surface that matches the inside surface of the finished airfoil, as described in application FR 2 961 552 filed in the name of the Applicant.

In the techniques currently in use, a refractory core made of ceramic is placed in a mold and then a metal or metal alloy is cast between the mold and the core in order to form the airfoil. On cooling, due to the difference in coefficients of thermal expansion for the metal and the core, the metal airfoil shrinks more than the ceramic core, so the ceramic core then exerts forces on the metal airfoil that give rise to stresses therein. With monocrystalline airfoils, the stresses that are induced can lead to recrystallization, which is incompatible with the airfoil being used.

The invention seeks to remedy such drawbacks, at least in part.

SUMMARY OF THE INVENTION

To this end, the present disclosure relates to a refractory core for fabricating a hollow turbine engine airfoil using the lost-wax casting technique, the core comprising a main body and at least one shell connected to the main body and defining a cavity between the main body and the shell, the shell being configured to come into contact with the airfoil during fabrication.

In the present disclosure, the term "refractory" designates a material that withstands high temperatures sufficiently to be suitable for use in lost-wax casting of a turbine engine airfoil. The refractory material making up the core may be a ceramic material, e.g. a refractory material based on alumina ($Al_2O_3$), on silica ($SiO_2$), or on zirconia ($ZrO_2$). The refractory core may also be made of refractory metal. In an example, the refractory core may essentially comprise one of the following elements: Si, Hf, Ta, B, W, Ti, Nb, Zr, Mo, V. In addition, the refractory core presents mechanical behavior that is elastic and fragile.

Unless specified to the contrary, "a" or "the" shell is used below to mean at least "one" or "the at least one" or indeed "each" shell. Conversely, the generic use of the plural may include the singular.

The core extends in a longitudinal direction. The longitudinal direction of the core corresponds to the longitudinal direction of the airfoil, which direction extends from the airfoil root to the airfoil tip. Sections perpendicular to the longitudinal direction are referred to as cross-sections. Seen in cross-section, the cavity is closed, such that the metal can be cast around the core, and thus around the shell, without penetrating into the cavity.

The shell may be fitted onto the main body or it may be made integrally with the main body.

The cavity formed by the shell and the main body is not porous, but is rather a macroscopic cavity. In particular, in cross-section, the mean diameter of the cavity is of the order of a few tenths of a millimeter to a few millimeters.

Because of the cavity, the shell may collapse when it is subjected to forces that are applied to the outside of the cavity, in particular forces caused by the metal shrinking as it cools. The shell breaking releases space that allows the metal to shrink freely, thereby having the effect of reducing residual stresses in the metal during cooling. Because of such a core, it becomes possible to cast hollow monocrystalline airfoils while avoiding any recrystallization due to excessive stresses in the metal, even for airfoil shapes that normally present high concentrations of stresses.

Furthermore, the shell is also subjected to forces while the metal is being cast. Nevertheless, those forces are much less than the forces acting on the shell during cooling the metal. Given the general knowledge of the person skilled in the art, it is thus possible to dimension the shell so that it withstands casting of the metal and breaks as from a certain level of stress while the metal is cooling.

The present disclosure also provides fabrication of a core as described above by additive manufacturing, e.g. by stereolithography.

In some embodiments, the shell defines a volume that is convex. It should be recalled that a volume (or a surface) that is convex is a volume (or a surface) such that for any two points of that volume (or that surface), the straight line segment connecting those two points together is contained entirely within the volume (or the surface). In particular, seen in one or any cross-section, the shell defines a surface that is convex. Such a shape is advantageous insofar as stresses concentrate in zones of high curvature.

In some embodiments, the main body is solid. In the present disclosure, the term "solid" means that the main body does not have any holes and is not porous. In these embodiments, the main body is dense and compact. Thus, in spite of the presence of the cavity, the refractory core as a whole conserves sufficient stiffness in bending. In addition, the zones that present cavities, i.e. the shells, are used only in zones of the airfoil that are subjected to high levels of stress while cooling.

In some embodiments, the main body is to come in contact with the airfoil, in particular with its portions where stresses during cooling are lower than in the portions that are to come into contact with the shell. For example, the main body may be for coming into contact with portions of the airfoil that are substantially plane. In such embodiments, the shell does not surround the entire main body.

In some embodiments, the refractory core further comprises at least a first piece of reinforcement arranged inside the cavity, extending from one point of the shell to another point of the shell. The first piece of reinforcement is distinct from the main body and from the shell. The first piece of reinforcement may extend over the full height of the core or over only a fraction of the height of the core. The first piece of reinforcement may include one or more recesses. The first piece of reinforcement may be plane or non-plane. The shape of the first piece of reinforcement may be determined on the basis of general knowledge of the person skilled in the art as a function of the values desired for certain criteria such as breaking strength, elastic limit, etc. The refractory core may have a plurality of first pieces of reinforcement.

In some embodiments, the refractory core further comprises at least second piece of reinforcement arranged inside the cavity and extending from a point of the shell to a point of the first piece of reinforcement. Thus, the first and second pieces of reinforcement form a structure for reinforcing the shell. The second piece of reinforcement may have some or all of the characteristics mentioned above for the first piece of reinforcement. In an example, the first and second pieces of reinforcement may be arranged so that together their cross-section is generally T-shaped.

In some embodiments, at least one of the pieces of reinforcement includes an intermediate portion forming a preferential breakage zone. The presence of a preferential breakage zone serves to control the point at which the piece of reinforcement breaks and thus to determine accurately the breaking strength of the shell.

The intermediate portion may form part of the first piece of reinforcement and/or of the second piece of reinforcement. For example, the intermediate portion forming a preferential breakage zone may be situated at the intersection between the first and second pieces of reinforcement. Thus, the reinforcing structure supporting the shell breaks when the intermediate portion breaks.

For example, the intermediate portion forming a preferential breakage zone may be in the form of a thinning in the piece(s) of reinforcement, or indeed a notch in at least one of the pieces of reinforcement.

In some embodiments, one or each piece of reinforcement presents in cross-section an aspect ratio of at least 2, preferably of at least 2.5, more preferably of at least 3, more preferably of at least 3.5, more preferably of at least 4. In addition, it is preferable for the aspect ratio to be no greater than 50, more preferably no greater than 40, more preferably no greater than 30, more preferably no greater than 20, more preferably no greater than 10. The aspect ratio is the ratio of the longest length divided by the shortest length. It determines the strength of the piece of reinforcement, in particular when it is subjected to compression, traction, and/or bending forces.

In some embodiments, the cavity is generally in the form of a tube, the cavity being closed in the vicinity of the ends of the tube. Preferably, the ends of the cavity are closed in portions of the shell that are not to come into contact with the metal. Conversely, it is preferable for the shell to remain locally hollow in its portions that are to come into contact with the metal.

Thus, the cavity may be closed so that metal cannot penetrate into the inside of portions of the shell that are to come into contact with the metal.

For example, when the refractory core is made by additive manufacturing, the ends of the cavity may be closed during said additive manufacturing.

In some embodiments, the main body and the shell are a single piece. The main body and the shell are made out of the same material and between them they may present continuity of material. Alternatively, the shell may be separate and fitted to the main body.

The present disclosure also provides a fabrication method for fabricating a hollow turbine engine airfoil using the lost-wax casting technique with a refractory core as described above.

In some implementations of the method, prior to injecting wax on the refractory core, the refractory core is manually coated in wax. The prior coating forms a first layer of wax that may cover the core directly. After it has cooled, the first layer of wax forms a buffer layer serving to attenuate the forces actually acting on the refractory core. This ensures that the core withstands the stresses generated by shrinking of the wax that is subsequently injected onto the refractory core in greater quantity.

BRIEF DESCRIPTION OF THE DRAWING

The invention and its advantages can be better understood on reading the following detailed description of embodiments of the invention given as non-limiting examples. The description refers to the accompanying drawing, in which.

DETAILED DESCRIPTION OF THE INVENTION

Figure 1:
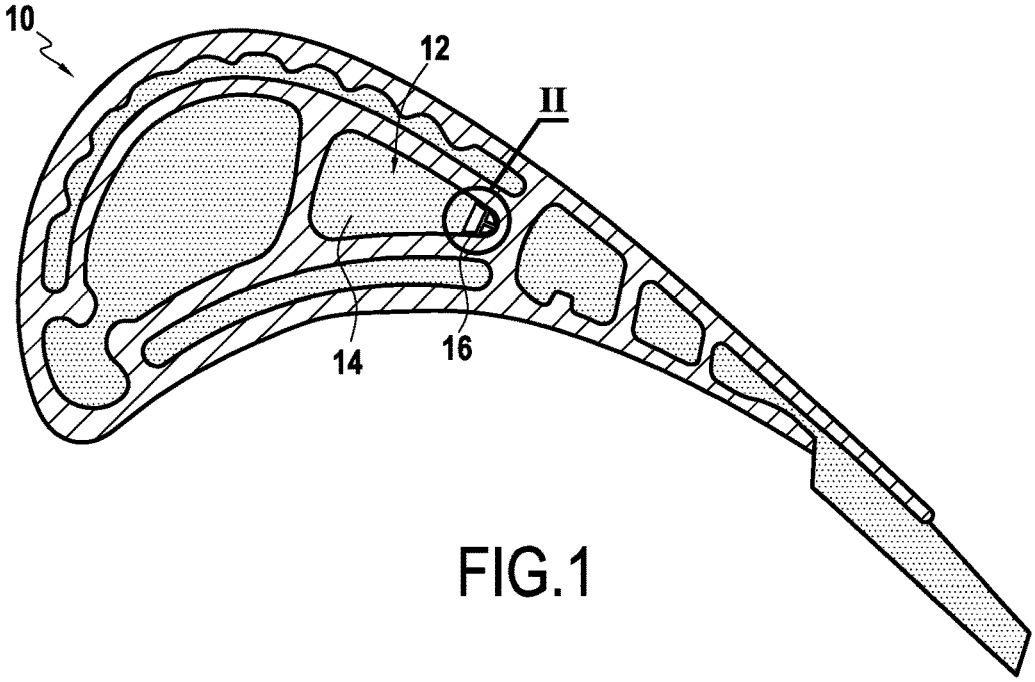
FIG. 1 is a diagrammatic cross-section view of an airfoil cast around a refractory core in a first embodiment.

FIG. 1 is a diagrammatic cross-section view of an airfoil 10 cast around a refractory core 12 in a first embodiment. In the present example, the airfoil 10 is a turbine airfoil, however the refractory core 12 could also be used to cast other types of airfoil.

In the present embodiment, the refractory core 12 is made of ceramic and is thus referred to below as the "ceramic" core 12. More precisely, in this example the refractory core 12 has the following composition (percentages by weight): coarse vitreous silica 58% to 69%, fine vitreous silica 8% to 19%, zircon ($ZrSiO_4$) 20%, and cristobalite 3%. Nevertheless, as mentioned above, the refractory core 12 could equally be made of some other material, typically a refractory metal or a refractory metal alloy.

As mentioned above, the airfoil 10 is hollow so as to enable it to be cooled by an internal flow of air. The ceramic core 12 serves to form the internal cavities in the airfoil, the outside surface of the ceramic core 12 corresponding substantially to the inside surface of the airfoil 10.

The ceramic core 12 comprises a main body 14 and a shell 16. In this example, the ceramic core 12 includes a single shell 16, but it could have more than one. The main body 14 and the shell 16 are described in detail with reference to FIG. 2, which shows a detail of FIG. 1.

Figure 2:
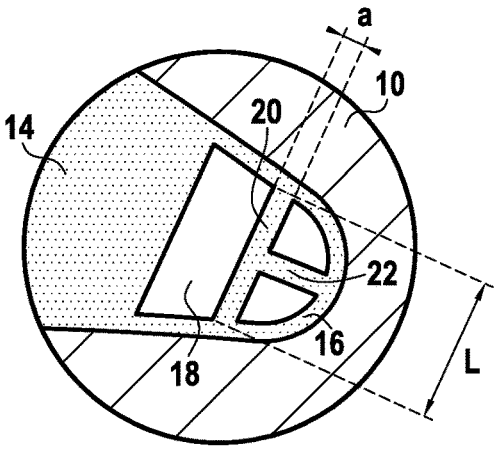
FIG. 2 shows a detail of FIG. 1.

The shell 16 is connected to the main body 14. Thus, the shell 16 co-operates with the main body 14 to define a cavity 18. The cavity 18 is thus situated between the main body 14 and the shell 16. The shell 16 forms a wall that is relatively thin compared with the main body. Furthermore, as shown in FIG. 2, the shell 16 is configured to come into contact with the airfoil 10 during fabrication. Furthermore, unlike the shell 16, the main body 14 is solid.

As shown in FIG. 1, the presence of the shell 16 is advantageous in regions of high curvature in the cooling channels of the airfoil. Specifically, regions of high curvature present particularly high concentrations of stresses. Thus, the shell 16 defines a volume that is convex, or at least in cross-section (i.e. in the plane of FIGS. 1 and 2), the shell 16 defines a surface that is convex.

In the present embodiment, the ceramic core 12 has a first piece of reinforcement 20 and a second piece of reinforcement 22. The first piece of reinforcement 20 is arranged inside the cavity 18. In this example, the first piece of reinforcement 20 is rectilinear in cross-section. The first piece of reinforcement 20 extends from one point of the shell 16 to another point of the shell 16, thus crossing the cavity 18. The second piece of reinforcement 22 is arranged inside the cavity 18. In this example, the second piece of reinforcement 22 is rectilinear in cross-section. The first piece of reinforcement 20 extends from a point of the shell 16 to a point of the first piece of reinforcement 20. In this case, the first piece of reinforcement 20 and the second piece of reinforcement 22 together present a cross-section that is generally T-shaped. Furthermore, the first piece of reinforcement 20 and the second piece of reinforcement 22 in this example extend over the entire length of the ceramic core 12 (i.e. its length in the longitudinal direction, along an axis perpendicular to the plane of FIG. 2).

In the cross-section shown in FIG. 2, the first piece of reinforcement 20 presents an aspect ratio L/a of about 6.6. The second piece of reinforcement 22 presents an aspect ratio of about 4. In any event, it is preferable for each piece of reinforcement to have an aspect ratio lying in the range 2 to 50.

In order to prevent metal from penetrating into the cavity 18 while casting the airfoil 10, it is also preferable to close the cavity 18. Furthermore, in order to ensure that the closed portion does not lead to the benefit of the cavity 18 being lost, it is preferable for the cavity to be closed in the vicinity of its ends in the longitudinal direction, preferably in portions of the shell that are not to come into contact with the metal while it is cooling. In an embodiment in which the ceramic core is made by additive manufacturing, the closed portions may be manufactured continuously with the shell and the main body, together with any pieces of reinforcement.

Figure 3:
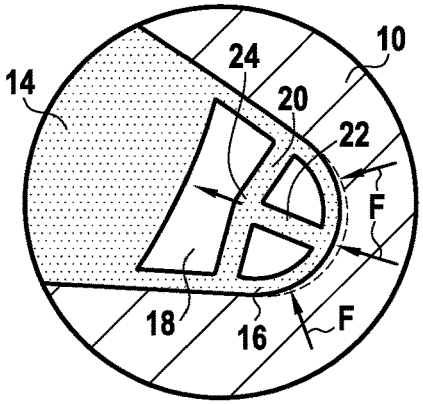
FIG. 3 is a view similar to FIG. 2 when the metal of the airfoil exerts forces on the refractory core during the cooling that follows solidification of the metal.

During cooling of the airfoil 10 after the metal has been cast, the airfoil 10 and the ceramic core 12 shrink differentially because of their different coefficients of thermal expansion. The metal airfoil 10 shrinks more than does the ceramic core 12 and it exerts forces F on the ceramic core as shown diagrammatically in FIG. 3 that act towards the main body 14. Under the effect of these forces, which are particularly intense in zones of high curvature in the airfoil 10, the shell 16 and the pieces of reinforcement 20, 22 deform. In particular, the first and second pieces of reinforcement present an intermediate portion 24 at their intersection in which a preferential breakage zone is formed. The intermediate portion 24 is given dimensions so that it constitutes the first point of breakage under the effect of the forces due to the airfoil 10 shrinking. Here, the preferential breakage zone nature of the intermediate portion 24 is ensured in this example by the T-shaped intersection between the first and second pieces of reinforcement 20 and 22, with the intermediate portion 24 being situated at the intersection between the first and second pieces of reinforcement 20 and 22.

When the forces F exceed a certain threshold as predetermined by the shape and by the materials of the ceramic core 12, the intermediate portion 24 breaks, thereby weakening the reinforcing structure formed by the pieces of reinforcement 20 and 22 and breaking the shell 16. As a result, the ceramic core 12 no longer constitutes an obstacle to the airfoil 10 shrinking freely in the location where the shell 16 is now broken. Consequently, residual stresses in the airfoil 10 are greatly diminished and recrystallization phenomena can be avoided.

The ceramic core 12 may be made by additive manufacturing or by any other method suitable for making the shell 16 and its pieces of reinforcement 20, 22, if any. It is also possible to manufacture it by injection molding the solid portion of the ceramic core 12 and the shell 16 separately out of ceramic material and then bonding them together, e.g. with a refractory adhesive.

Once the ceramic core 12 has been made, the lost-wax casting method of fabricating the airfoil 10 is conventional and consists initially in forming an injection mold into which the ceramic core 12 is placed prior to injecting wax. The wax model as created in this way is then dipped in slurries constituted by a suspension of ceramic in order to make a casting mold (also referred to as a "shell" mold). Finally, the wax is eliminated and the shell mold is fired so as to enable molten metal to be cast therein.

While performing the method, after wax has been injected onto the ceramic core 12, the cooling of the wax model of the airfoil can give rise to forces that are similar to those that appear during cooling of the metal airfoil 10. However the shell 16 must not break at this stage. For this purpose, a first option for the person skilled in the art is to give the shell 16 dimensions, e.g. by running digital simulation, to ensure that it withstands the forces exerted by the wax as it cools and that it breaks only under the greater forces as exerted by the metal while it cools.

A second option that may be used as an alternative or in addition, consists, prior to injecting the wax onto the ceramic core 12, in manually coating the ceramic core 12 in wax. This step is referred to as "pre-waxing" the core. This prior coating may be performed directly on the surface of the ceramic core 12. The coating may be performed over the entire surface of the ceramic core 12, over only the shell 16, or indeed over any portion of the outside surface of the ceramic core 12. This prior coating forms a buffer layer that serves to attenuate the forces that actually act on the ceramic core 12, thereby protecting the shell 16 from breaking. In addition, the prior coating of wax can be removed from the core at the same time as the complete wax model is removed.

Figure 4:
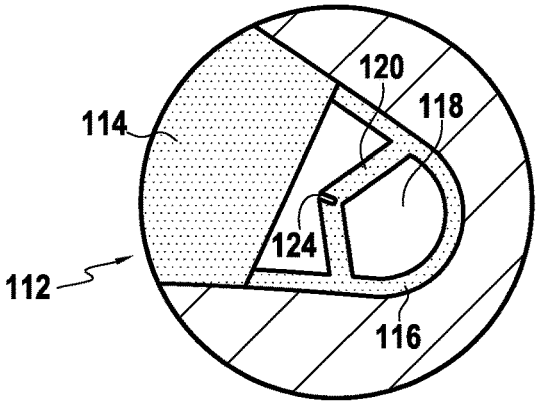
FIG. 4 is a diagrammatic detail view of a refractory core in a second embodiment.

FIG. 4 shows another embodiment of the ceramic core. The ceramic core 112 of FIG. 4 is identical to the ceramic core 12 of the first embodiment except concerning the pieces of reinforcement and the aspects set out below. Thus, the main body 114, the shell 116, and the cavity 118 are not described again.

The ceramic core 112 has first piece of reinforcement 120 that is substantially V-shaped. Furthermore, the first piece of reinforcement includes an intermediate portion 124 forming a preferential breakage zone. Specifically, the intermediate portion 124 is in the form of a notch in the first piece of reinforcement. The intermediate portion 124 thus forms a zone in which stress becomes concentrated, thereby giving rise to a preferential breakage zone.

In addition, in this embodiment, the ceramic core 112 is obtained by a method in which the main body 114 and the shell 116 are fabricated separately, e.g. by injection molding ceramic material, and then assembled together, e.g. by adhesive.

Although the present invention is described for a ceramic core and an airfoil made of metal or of metal alloy, numerous variations in shape and material are possible, the invention remaining applicable whenever the respective materials of the airfoil and of the core present the same phenomenon of differential shrinkage.

Although the invention is described with reference to specific embodiments, modifications may be made thereto without going beyond the general ambit of the invention as defined by the claims. In particular, individual characteristics of various embodiments shown and/or mentioned may be combined in additional embodiments. Consequently, the description and the drawings should be considered in a sense that is illustrative rather than restrictive.

The invention claimed is:

1. A refractory core for fabricating a hollow turbine engine airfoil using the lost-wax casting technique, the core comprising a main body and at least one shell connected to the main body and defining a cavity between the main body and the shell, the shell being configured to come into contact with the airfoil during fabrication, the cavity being closed so that the casting material does not penetrate into the cavity while casting the airfoil.

2. The refractory core according to claim 1, wherein the shell defines a volume that is convex.

3. The refractory core according to claim 1, wherein the main body is solid.

4. The refractory core according to claim 1, further comprising at least a first piece of reinforcement arranged inside the cavity, extending from one point of the shell to another point of the shell.

5. The refractory core according to claim 4, further comprising at least a second piece of reinforcement arranged inside the cavity and extending from a point of the shell to a point of the first piece of reinforcement.

6. The refractory core according to claim 5, wherein at least one of the pieces of reinforcement comprises an intermediate portion forming a preferential breakage zone.

7. The refractory core according to claim 5, wherein each piece of reinforcement presents, in cross-section, an aspect ratio lying in the range 2 to 50.

8. The refractory core according to an claim 1, wherein the cavity is generally in the form of a tube, the cavity being closed in the vicinity of the ends of the tube.

9. The refractory core according to an claim 1, wherein the main body and the shell are a single piece.

10. A fabrication method for fabricating a hollow turbine engine airfoil using the lost-wax casting technique with a refractory core according to an claim 1.

11. The fabrication method according to claim 10, wherein, prior to injecting wax on the refractory core, the refractory core is manually coated in wax.

* * * * *